US005803648A

United States Patent [19]

Foy

[11] Patent Number: 5,803,648

[45] Date of Patent: Sep. 8, 1998

[54] HARNESS PLATE

[76] Inventor: Peter S. Foy, c/o Foy Inventerprises, Inc. 3275 E. Patrick La., Las Vegas, Nev. 89120

[21] Appl. No.: 696,440

[22] Filed: Aug. 14, 1996

[51] Int. Cl.[6] ..... B25G 3/18

[52] U.S. Cl. ..... 403/325; 403/321; 403/326; 403/327; 24/265 AL

[58] Field of Search ..... 403/325, 326, 403/327, 330; 24/265 AL, 265 EC, 335, 326, 371, 598.3, 588

[56] References Cited

U.S. PATENT DOCUMENTS

| | | | |
|---|---|---|---|
| 1,340,206 | 5/1920 | Ballou, Jr. | 24/598.3 |
| 1,548,023 | 8/1925 | Cowell | 24/371 X |
| 2,307,808 | 1/1943 | Segal | 24/598.3 X |
| 2,431,358 | 11/1947 | Wilson | 24/265 AL X |
| 2,574,296 | 11/1951 | Smith | 24/265 AL X |
| 4,229,000 | 10/1980 | Scherling | 272/52 |
| 4,554,881 | 11/1985 | Lane | 114/39 |
| 4,821,543 | 4/1989 | Scungio | 24/371 X |
| 5,215,023 | 6/1993 | Johnson | 114/39.2 |
| 5,333,333 | 8/1994 | Mah | 5/81.1 |

FOREIGN PATENT DOCUMENTS 617238 2/1949 United Kingdom .

*Primary Examiner*—Daniel P. Stodola
*Assistant Examiner*—Bruce A. Lev
*Attorney, Agent, or Firm*—Biebel & French

[57] ABSTRACT

A harness plate (22, 28) for attachment to a harness for securing a first load (4), normally in the form of a person, the harness plate being attachable to a first cable (18) which is used to lift the load. The harness plate comprises a quick release mechanism (24) arranged to releasably receive a second cable (20) from which a second load (6), also normally in the form of a person, can be depended.

5 Claims, 3 Drawing Sheets

HARNESS PLATE

BACKGROUND OF THE INVENTION

1. Field of the Invention

This invention relates to a harness plate for releasably supporting a harnessed person or article from a suspension wire or cable and is more particularly, but not exclusively, concerned with a harness plate for use in theatrical or stage work where a person needs to be suspended, for example, in theatrical "flying".

2. Description of the Prior Art

Known theatrical flying equipment has the capability, among others, to rotate a person or article through 180° or more, to move a person around a stage area and to lift and lower the person. The equipment also enables movement of the person with respect to their support cables i.e. somersaulting.

As a result of approximately 100 years of development, almost unrestricted movement of a single harnessed person is possible using known equipment. The resultant impressive manoeuverability of a single person has led to flying and floating or swimming effects which are not limited significantly by the suspending and manoeuvering equipment used.

However, people skilled in the art of theatrical flying still find the available equipment extremely limiting when attempting to fly two or more persons in close proximity, due to the inevitable and potentially dangerous entangling of their support cables. Furthermore, it is currently impossible to fly a first person directly above or directly below a second person.

SUMMARY OF THE INVENTION

It is an object of the present invention to provide a harness plate which enables flying of two person in close proximity without the risk of entangling their support cables.

According to a first aspect of the present invention there is provided a harness plate for attachment to a harness for securing a first load, said harness plate being attachable to a first cable which is arranged to lift said load, when in use, the harness plate comprising a quick release mechanism arranged to releasably receive a second cable from which a second load can be depended.

According to a second aspect of the present invention there is provided a load support system comprising a crossbar from which two support cables depend, so as to be arranged on opposite sides of a first load to be supported by the system, each of the support cables being attachable to the first load by a harness plate substantially as herein described.

According to a third aspect of the present invention there is provided a method of simulating the flight of two persons, a first of which is supported by a cable which is attached to a harness plate substantially as herein described, the second person then being supported below said first person by a second cable which is releasably attachable to a further harness plate, such that complex movement of the persons with respect to each other is enabled without entangling said first and second cables.

BRIEF DESCRIPTION OF THE DRAWINGS

An embodiment of the present invention will now be described, by way of example, with reference to the accompanying drawings, in which.

DESCRIPTION OF THE PREFERRED EMBODIMENT

Prior to detailing a specific embodiment of a harness plate in accordance with the present invention, a support system utilising such harness plates will be reviewed, because an understanding of the increased manoeuverability which such a system provides, without risk of entangling support cables, is essential in understanding the merits of the harness plates in question.

Figure 1A:
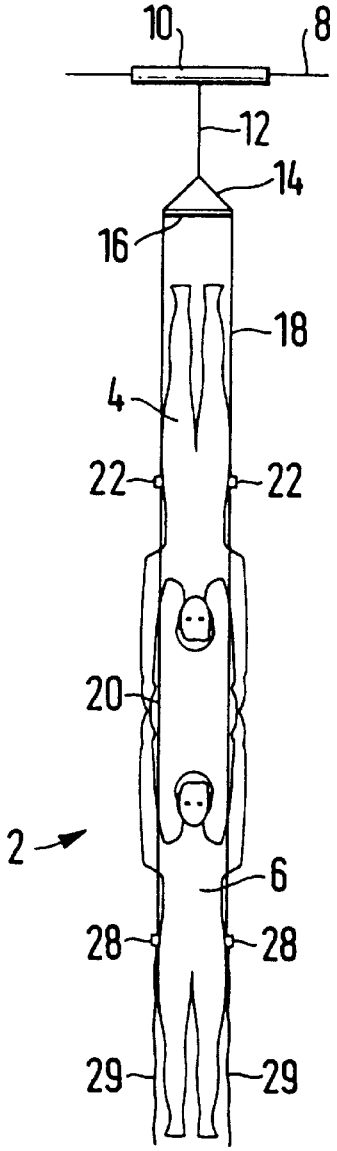
FIG. 1*a* is a front schematic view of a support system utilising harness plates in accordance with the present invention, in order to support two persons in close proximity.
Figure 1B:
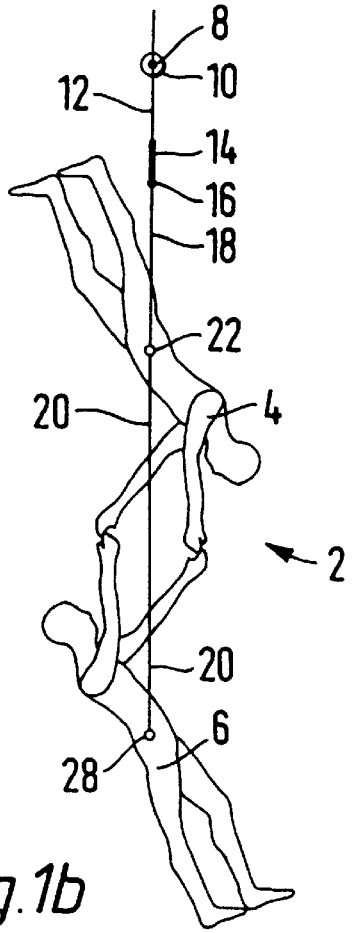
FIG. 1*b* is a schematic side view of the support system of FIG. 1*a;*

FIGS. 1*a* and 1*b* show a support system 2 for supporting two persons 4 and 6. The support system 2 comprises a substantially horizontal cable 8 on which a load bearing pulley 10 is located, in a known manner, so as to enable lateral movement of the pulley 10 and persons 4 and 6 depended therefrom. A down cable 12 is suspended from the pulley 10 and a substantially triangular crossbar 14 is suspended from the down cable 12. A support cable 18 is suspended from opposite ends of a horizontal arm 16 of the crossbar 14 so as to be located on opposite sides of each of the two persons 4 and 6. A support system for a single person, substantially as described above, is known in the art and the components of the system which are required to provide a single person with the desired degree of manoeuverability will, therefore, not be described further herein.

Each of the persons 4, 6 which are to be suspended from the support system 2 are provided with a harness, of known design, to which is attached a pair of harness plates 22, 28, in accordance with the present invention. Each harness plate 22, 28 is located on the harness so as to be located on the side of the persons 4 and 6, preferably at their waist or hips.

The harness plates 22 attached to the first person 4 each comprise a first quick-release mechanism 24 (FIG. 2*a*) for attachment, through a cable eye (not shown), to the first cable 18 arranged to lift the person 4 as described above. Each of these harness plates 22 comprise a second quick-release mechanism 26 arranged to releasably receive a cable eye (not shown), attached to a second cable 20 from which the second person 6 is depended. The second cables 20 are each attached to the second person 6 via a pair of harness plates 28 each of which is located on the second person's hips or waist. As both persons are attached to the support system 2 via harness plates 22, 28 having a pair of quick-release mechanisms 24, 26 such that the second person is always depended from the second cables 20 which are substantially parallel and contiguous with the first cables 18 there is no risk of the cables 18 and 20 becoming entangled. Therefore a variety of inventive and complex maneuvres and choreography are possible with a support system in accordance with the present invention which would not be possible if each person were depended from a separate support pulley, as in the prior art. For example, when in use, the above described support system enables the second person 6 to be connected to a further set of cables (not shown), which are in turn connected to a separate support pulley, for movement independent of said first person, when the cables 20 are not attached to the first harness plates 22. Once the choreography of a piece requires the persons 4, 6 to be lifted and manoeuvred together the further set of cables is detached from the harness plate 28 and the second set of cables 20 is attached between the harness plates 22, 28 whereupon movement of the first person 4 results in corresponding movement of the second person 6 suspended below the first person 4. Likewise, it is possible to re-attach said further set of cables to said harness plates 28 to maintain the connection between the harness plates 28 and the harness plates 22 and to disconnect the cables 18 between the harness plates 22 and the crossbar 14. Thus, it is possible to raise the second person 6 above the first person 4, as well as raising the first person 4 above the second person 6. All of this connection and disconnection of cables can be carried out as part of an on-stage choreography thus preserving the illusion of flight and providing greater scope for manoeuvring the persons in relation to each other while still preventing any entangling of cables.

Figure 2B:
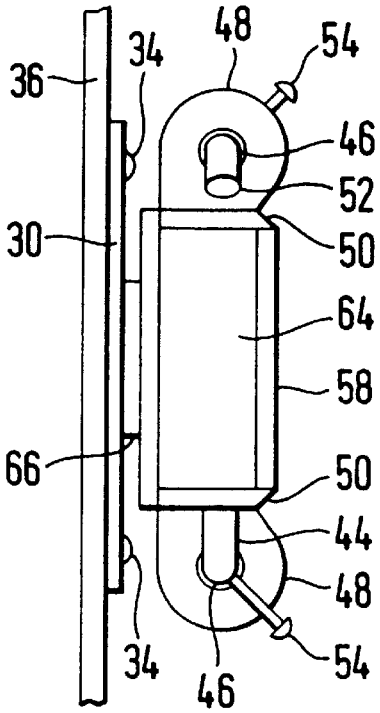
FIG. 2*b* is a side view of the harness plate of FIG. 2*a;*.
Figure 2A:
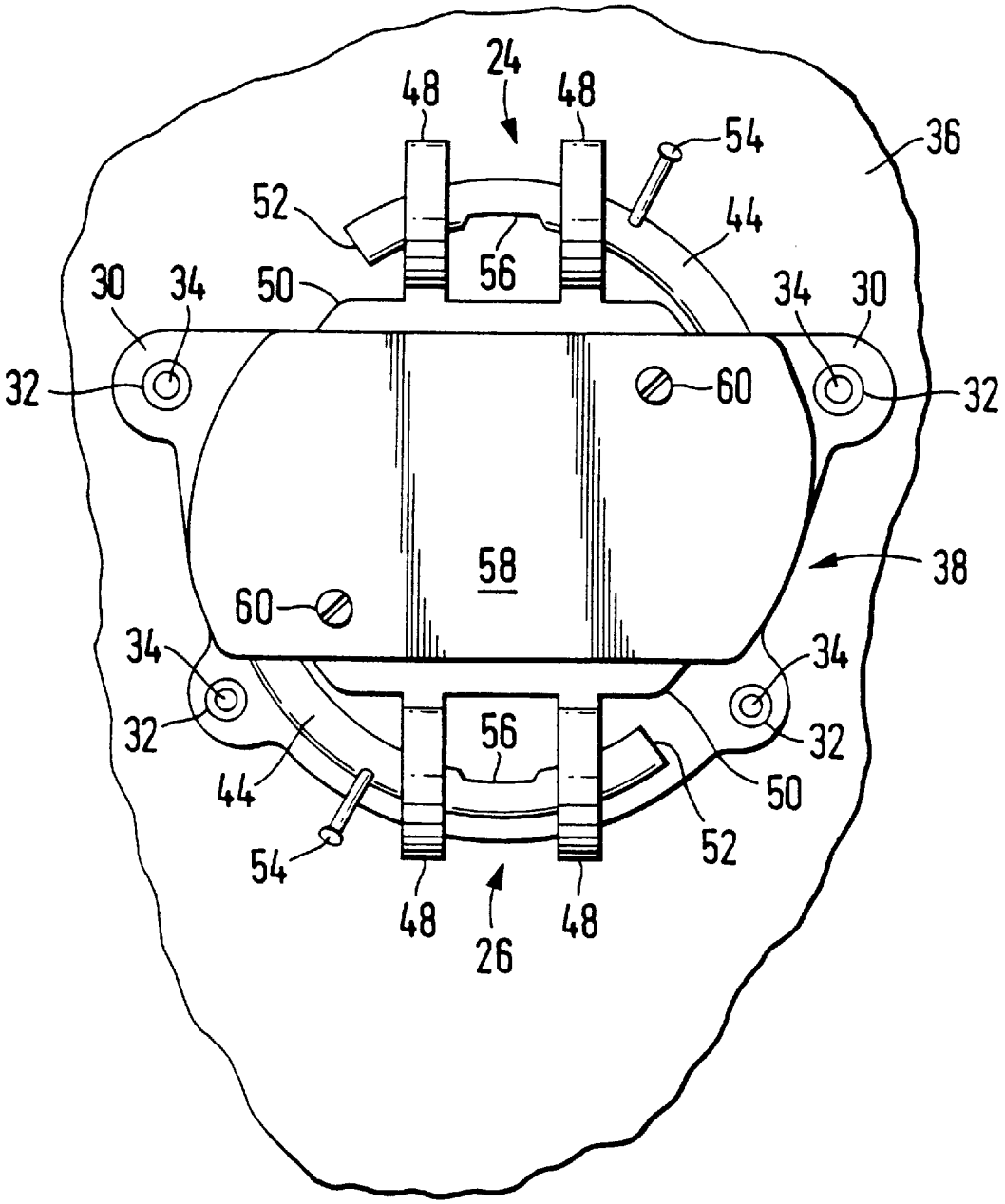
FIG. 2*a* is a front view of a harness plate in accordance with the present invention.
Figure 3:
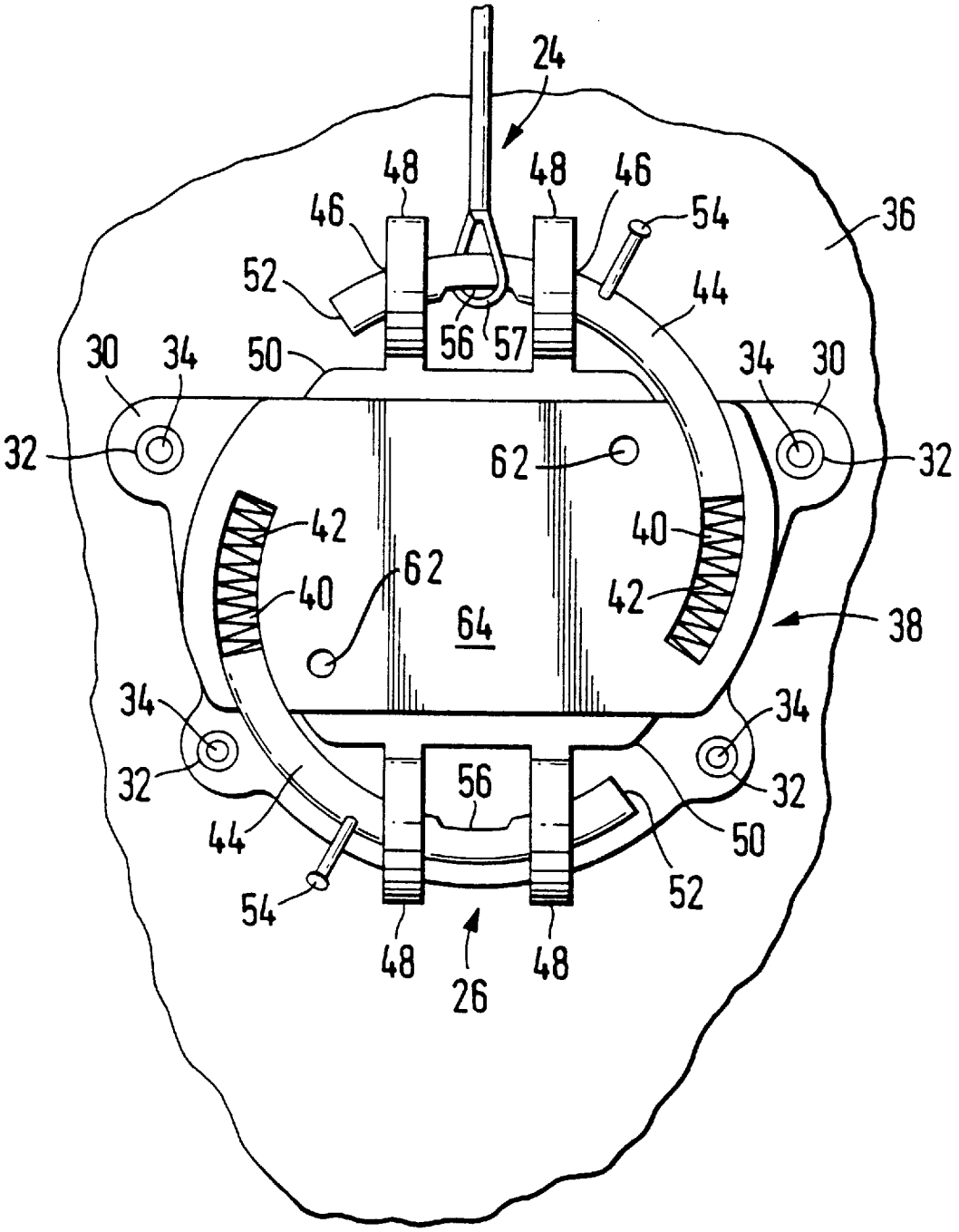
FIG. 3 is a front view of the harness plate, as in FIG. 2*a,* with a top cover removed.

Referring to FIGS. 2 and 3, the harness plate 22, 28 each comprise a mounting plate 30 having a peripheral array of four holes 32 for receiving rivets 34, for securing the mounting plate 30 to a harness, a portion of which is illustrated with reference 36. The plate 30 on its forward face is formed with a raised, generally cylindrical portion 38, extending through which are two circumferential paths or recesses 40. Within each of the recesses 40 is located a spring 42 and a portion of a shackle pin 44. Each shackle pin 44 extends out of its recess 40 and through a hole 46 in each of a pair of arms 48.

Each pair of upwardly extending spaced parallel arms 48 are formed on a central upper portion of the raised portion 38 with the arms 48 spaced apart symmetrically on opposite sides of the vertical centre line of the raised portion 38. To this end, the raised portion 38 at the upper and lower edge is formed with a forwardly extending central flange portion 50. The shackle arms 48 extend upwardly from the flange portion 50 and are of parallel plate-like form with arcuate upper ends extending widthwise in planes normal to the plate 30.

Each compression spring 42 is arranged to bias the corresponding shackle pin 44 counterclockwise to the position shown in FIG. 3, and to accommodate compression sufficient to allow clockwise movement of the pin from the FIG. 3 position to clear the pin head 52 from the space between the arms 48. A finger-like projection 54 extends from the pin 44 generally radially outwardly in forwardly inclined manner at a side of the shackle arms 48 opposite to the pin head 52. The projection 54 is arranged to be clear of the adjacent shackle arms 48 when the spring 42 is relaxed to facilitate manual engagement for release purposes by urging the pin 44 clockwise against the spring 42.

Inwardly of the pin head 52 the pin 44 is formed on its lower, radially inner surface with a shallow recess 56 arranged, when the pin 44 is in the FIG. 3 condition, between the arms 48. The recess 56, when the harness plate is in use, engages a support cable or wire or eye 57 so that under supportive tension the shackle pin 44 is locked relative to the shackle arms 48.

Referring particularly to FIGS. 2*a* and 2*b* each harness plate 22, 28 includes a top plate 58 which is attached (FIG. 2*a*) to the main body of the harness plate by screws 60, which are received in screw holes 62 (FIG. 3), in the body 64 of the harness plate. The main body 64 (FIG. 2*b*) of the harness plate is mounted on a rotatable mount 66 to the mounting plate 30 which is in turn attached to the harness 36, as described above.

Modifications may be made to the specific embodiment described above, as will be readily apparent to those skilled in the art, without departing from the invention as defined in the corresponding claims. For example, the harness plates may be located on different parts of the person's bodies and a different number of cables may be utilised. Also, the first and second quick-release mechanisms may be different in design e.g. the pin 54 may be located in a different position or may be of a different shape so that the wrong mechanism is not released during use. Still further, a third person may be depended from the second person in the same manner as the second person is depended from the first person, etc.

I claim:

1. Theatrical apparatus for suspending persons so as to perform an illusion of flying, said apparatus comprising a harness plate including:

a rotationally symmetrical body;

means for attaching said plate to a harness intended to be worn by a first person;

a first release mechanism for releasably attaching said plate to a first suspended cable;

a second release mechanism for releasably receiving a second cable from which a second person can be depended;

said first and second release mechanisms including means for operating said mechanisms independently of each other; each release mechanism comprising substantially semi-circular recess formed in said rotationally symmetrical body and two protruding bars having aligned holes and a space therebetween; a spring located in said recess; an arcuate shackle pin having a first portion and a second portion, said first portion being located in said recess and urged by said spring into a first position in which said second portion passes through both of said aligned holes; and means for moving the shackle pin in a rotational manner against said spring to a second position in which said second portion is moved clear of at least one of said bars, whereby said second portion of said shackle pin can be inserted into and removed from an eye of a cable when said shackle pin is in said second position and said cable can be securely attached to said release mechanism when said shackle pin is in said first position; and means for rotating the rotationally symmetrical body relative to the harness when the plate is attached thereto, whereby either release mechanism can be used independently to attach either cable to the harness plate and the attached persons can perform somersaults and other theatrical flying acts in close proximity to each other without entangling said cables.

2. Theatrical apparatus as claimed in claim 1, wherein said harness plate comprises a back plate and said rotationally symmetrical body is rotatably mounted on said back plate, said release mechanisms being formed in said rotationally symmetrical body.

3. Theatrical apparatus as claimed in claim 1, wherein each release mechanism includes means for preventing release of said cable when attached thereto whilst said cable is in tension.

4. Theatrical apparatus for suspending persons so as to perform an illusion of flying, said apparatus comprising:

a crossbar having two support cables depending therefrom; and a harness plate for attachment to each of said cables, each of said harness plates comprising a rotationally symmetrical body, means for attaching said plate to a respective side of a harness intended to be worn by a first person, a first release mechanism for releasably attaching said plate to one of said support cables, a second release mechanism for releasably receiving a second cable from which a second person can be depended, said first and second release mechanisms including means for operating said mechanisms independently of each other; each release mechanism comprising a substantially semi-circular recess formed in said rotationally symmetrical body and two protruding bars having aligned holes and a space therebetween; a spring located in said recess; an arcuate shackle pin having first portion and a second portion, said first portion being located in said recess and urged by said spring into a first position in which said second portion passes through both of said aligned holes; and means for moving the shackle pin in a rotational manner against said spring to a second position in which said second portion is moved clear of at least one of said bars, whereby said second portion of said shackle pin can be inserted into and removed from an eye of a cable when said shackle pin is in said second position and said cable can be securely attached to said release mechanism when said shackle pin is in said first position; and means for rotating the rotationally symmetrical body relative to the harness when the plate is attached thereto, whereby either release mechanism can be used independently to attach either cable to the harness plate and the attached persons can perform somersaults and other theatrical flying acts in close proximity to each other without entangling said cables.

5. Theatrical apparatus as claimed in claim 4, including two further harness plates releasably attached to said second cables respectively, said harness plates each including means for attaching said plate to a respective side of a harness intended to be worn by said second person.

* * * * *